US007306217B2

(12) United States Patent
Bandou et al.

(10) Patent No.: US 7,306,217 B2
(45) Date of Patent: Dec. 11, 2007

(54) IMAGE FORMING APPARATUS

(75) Inventors: Takayoshi Bandou, Anan (JP); Yoshihiko Imura, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 122 days.

(21) Appl. No.: 11/390,346

(22) Filed: Mar. 28, 2006

(65) Prior Publication Data

US 2006/0220295 A1 Oct. 5, 2006

(30) Foreign Application Priority Data

Apr. 1, 2005 (JP) ..... 2005-106668

(51) Int. Cl.
*B65H 1/00* (2006.01)

(52) U.S. Cl. ..... 271/145; 271/162; 271/207; 271/213

(58) Field of Classification Search ..... 271/162, 271/145, 207, 213; 347/104; 403/68, 67, 403/92, 93, 161, 163
See application file for complete search history.

(56) References Cited

U.S. PATENT DOCUMENTS

| | | | | |
|---|---|---|---|---|
| 5,111,252 | A * | 5/1992 | Hamada et al. | 399/393 |
| 5,234,212 | A * | 8/1993 | Dutra, Jr. | 271/207 |
| 5,464,205 | A * | 11/1995 | Bang | 271/213 |
| 6,382,617 | B1 * | 5/2002 | Yen et al. | 271/3.14 |
| 6,848,685 | B2 * | 2/2005 | Katsuyama | 271/162 |
| 7,073,787 | B2 * | 7/2006 | Kinsley et al. | 271/162 |
| 2002/0063374 | A1 * | 5/2002 | Takahashi | 271/10.01 |
| 2005/0127593 | A1 * | 6/2005 | Kinsley et al. | 271/162 |
| 2006/0017217 | A1 * | 1/2006 | Maeda | 271/162 |
| 2006/0163798 | A1 * | 7/2006 | Wong et al. | 271/162 |

FOREIGN PATENT DOCUMENTS

| | | | |
|---|---|---|---|
| JP | 07-309454 | A | 11/1995 |
| JP | 08-198480 | A | 8/1996 |
| JP | 2002-347997 | A | 12/2002 |
| JP | 2003-118854 | A | 4/2003 |

* cited by examiner

*Primary Examiner*—David H Bollinger
(74) *Attorney, Agent, or Firm*—Crowell & Moring LLP

(57) ABSTRACT

An image forming apparatus comprises a paper feed tray, which is attached to the apparatus body so as to be freely opened and closed with respect to the apparatus body, and a paper pressing plate disposed inside the apparatus body. The paper feed tray has a pair of protrusions on the inner surfaces of the side walls thereof. The paper pressing plate has a pair of notches formed by partially cutting the side portions of the plate so that, when the paper feed tray is in the closed position, the protrusions of the paper feed tray are received in the notches and the side faces of the paper pressing plate where the notches are formed face the protrusions in a manner that are almost in contact with the protrusions. When a force acts on the paper feed tray in the closed position to bend inward the side walls of the paper feed tray, the protrusions are pressed against the portions of the paper pressing plate where the notches are formed so as to stop the inward bending of the side walls. Accordingly, even when a user grasps the paper feed tray to lift the apparatus, the paper feed tray can be prevented from becoming detached from the apparatus body.

4 Claims, 8 Drawing Sheets

IMAGE FORMING APPARATUS

BACKGROUND OF THE INVENTION

1. Field of the Invention

The present invention relates to image forming apparatus such as printers, copiers, facsimiles, and the like.

2. Description of the Related Art

There are known image forming apparatus such as printers comprising a paper feed tray that is attached to the apparatus body so as to be freely opened and closed with respect to the apparatus body and that, in use, is opened to a horizontal position for holding a stack of paper thereon (see, for example, Japanese laid-open patent publication Nos. 2002-347997, Hei 7-309454, Hei 8-198480, and 2003-118854). Such an apparatus is designed so that the paper feed tray is kept closed when the apparatus is not in use, and it is opened for holding paper sheets when the apparatus is used, thereby saving space.

However, the above described conventional image forming apparatus comprising the paper feed tray have the following problem. As shown in FIG. 8, when carrying such an apparatus 101, a user Y may insert his/her one hand H under a paper feed tray 102 to lift the apparatus 101. The paper feed tray 102 is held on the apparatus body 110 via, for example, pivot shafts 121 and bearings 122 while the apparatus 101 is not lifted, i.e., placed on a surface, as shown in FIG. 9A. However, when the user Y grasps the paper feed tray 102 and lifts up the apparatus 101 from the position as shown in FIG. 8, the load G of the apparatus 101 is exerted on the pivot shafts 121 of the paper feed tray 102. Accordingly, as shown in FIG. 9B, a force acts on the paper feed tray 102 to bend inward the portions of the tray where the pivot shafts 121 are provided, which may cause the pivot shafts 121 to get off the bearings 122 and thus cause the paper feed tray 102 to be detached from the apparatus body 110.

SUMMARY OF THE INVENTION

An object of the present invention is to provide an image forming apparatus comprising an openable and closable paper feed tray that can keep the paper feed tray properly attached to the apparatus body even when a user grasps the paper feed tray to lift up the apparatus body.

According to an aspect of the present invention, an image forming apparatus comprises a paper feed tray that is attached to an apparatus body of the image forming apparatus so as to be freely opened and closed with respect to the apparatus body and that is opened to a position for holding a sheet of paper thereon when the image forming apparatus is used.

The paper feed tray includes: a plate portion on which the sheet of paper is placed; a pair of left and right side walls extending upward from two sides of the plate portion to be substantially perpendicular to the plate portion; a pair of left and right supported portions that are formed on outer surfaces of the side walls and are rotatably supported on the apparatus body by pivot shafts extending in a substantially horizontal direction substantially perpendicular to a paper feed direction; and a pair of left and right contact portions formed on inner surfaces of the side walls so that, when the paper feed tray is in the closed position, the contact portions are almost in contact with portions of side faces of an internal member that is disposed inside the apparatus body and positioned between the pair of side walls when the paper feed tray is in the closed position.

When a force acts on the paper feed tray in the closed position to bend inward the side walls of the paper feed tray, the contact portions are pressed against the portions of the side faces of the internal member so as to stop the inward bending of the side walls.

With the above configuration, when the force acts on the paper feed tray in the closed position to bend inward the side walls of the paper feed tray, the portions on the inner surfaces of the side walls come in contact with the portions on the side faces of the member inside the apparatus body, so that the inward bending of the side walls can be stopped. This can prevent the supported portions formed on the outer surfaces of the side walls from being displaced by a large amount from their normal positions, thus preventing the paper feed tray from becoming detached from the apparatus body.

Preferably, the paper feed tray has a pair of left and right protrusions extending from the inner surfaces of the side walls, the protrusions serving as the contact portions, wherein the internal member has a pair of left and right notches formed by partially cutting side portions of the internal member so that, when the paper feed tray is in the closed position, the protrusions are at least partially received in the notches and the side faces of the internal member where the notches are formed face the protrusions in a manner that are almost in contact with the protrusions, wherein, when the force acts on the paper feed tray in the closed position to bend inward the side walls of the paper feed tray, the protrusions are pressed against the portions of the internal member where the notches are formed so as to stop the inward bending of the side walls.

Preferably, the internal member is a paper pressing plate to press the sheet of paper placed on the paper feed tray against a transport mechanism located above the paper pressing plate.

While the novel features of the present invention are set forth in the appended claims, the present invention will be better understood from the following detailed description taken in conjunction with the drawings.

BRIEF DESCRIPTION OF THE DRAWINGS

The present invention will be described hereinafter with reference to the annexed drawings. It is to be noted that all the drawings are shown for the purpose of illustrating the technical concept of the present invention or embodiments thereof, wherein.

9B is a top view showing the paper feed tray of the conventional printer when the printer is lifted with the paper feed tray grasped by the user.

DESCRIPTION OF THE PREFERRED EMBODIMENTS

Referring now to the accompanying drawings, a preferred embodiment of the present invention is described. It is to be noted that the following description of preferred embodiment of the present invention has been presented for purposes of illustration and description, and is not intended to be exhaustive or to limit the present invention to the precise form disclosed.

Figure 1:
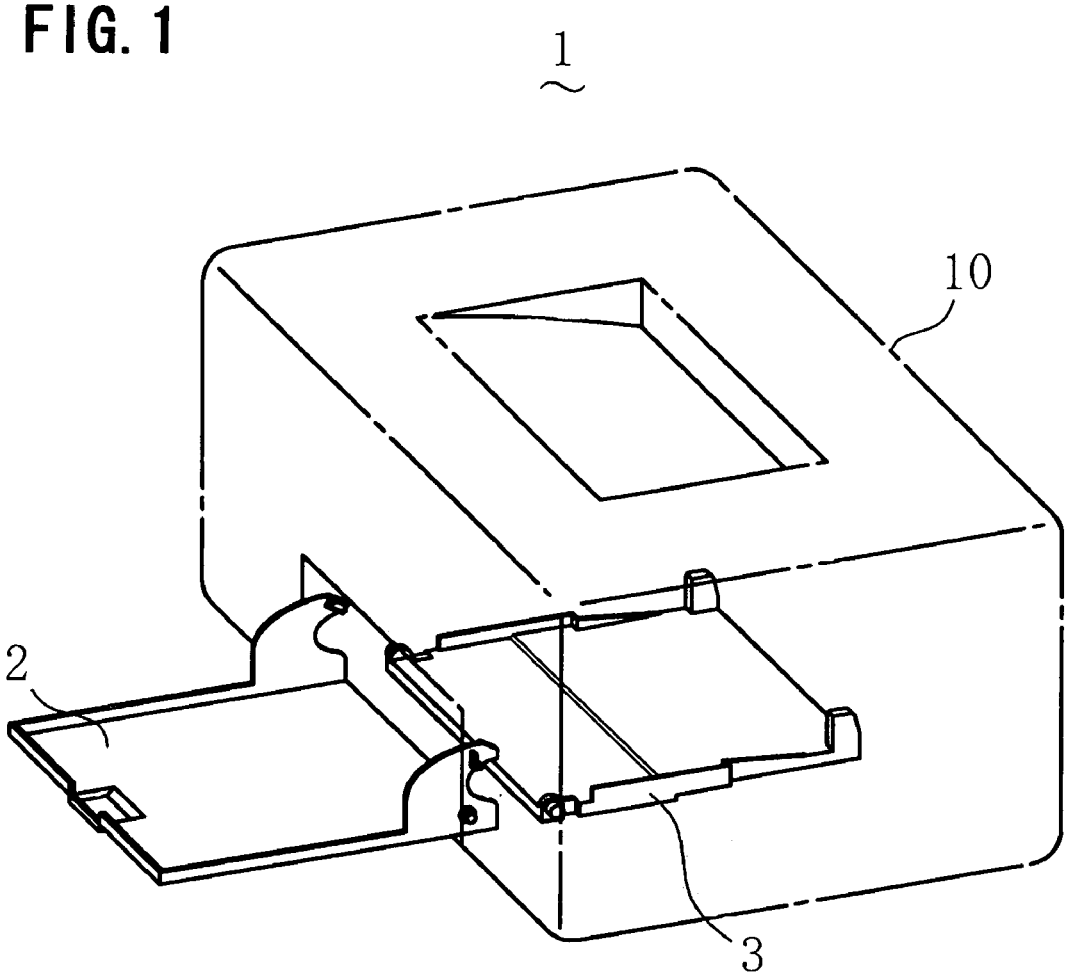
FIG. 1 is a perspective view showing a printer according to one embodiment of the present invention, with a paper feed tray in the open position.
Figure 2:
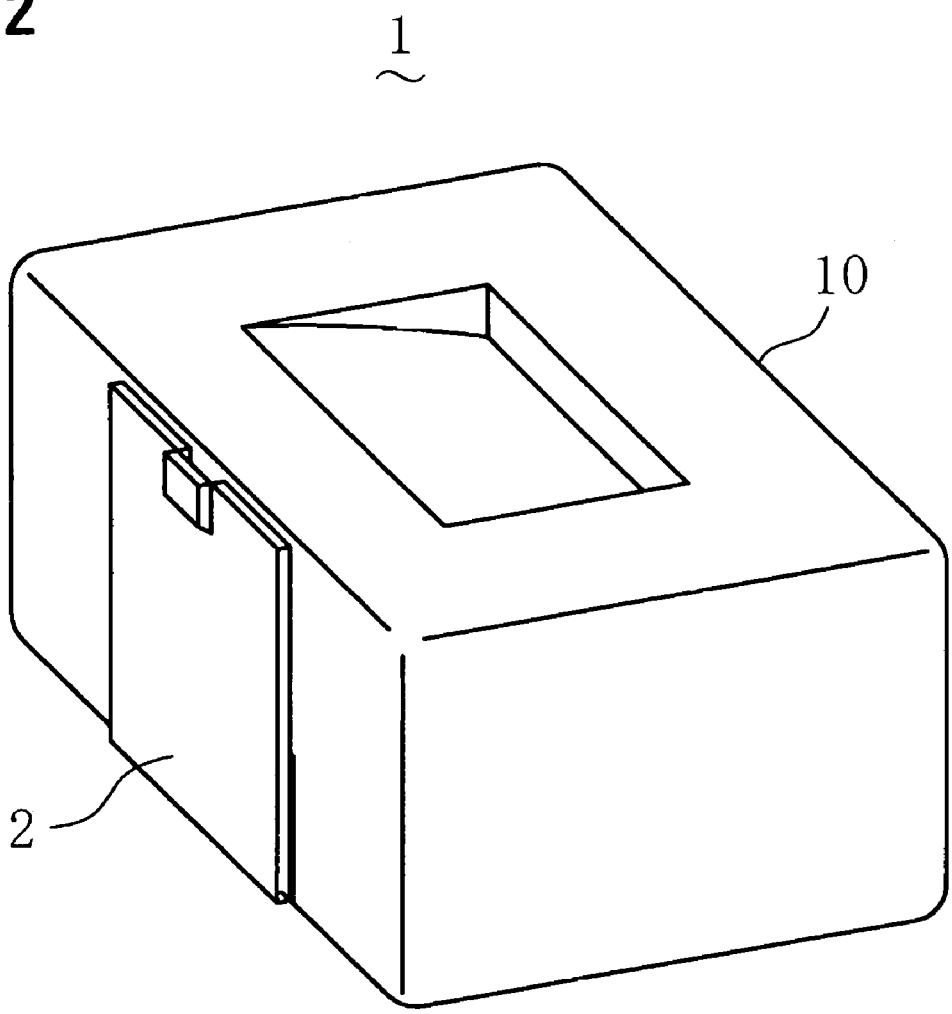
FIG. 2 is a perspective view of the printer with the paper feed tray in the closed position.

FIG. 1 shows a printer 1 according to one embodiment of the present invention. The printer 1 is an apparatus that prints an image on a sheet of paper or the like based on image data (which may contain text data) input via a device such as a personal computer connected thereto. As shown in FIG. 1, the printer 1 comprises a paper feed tray 2 that is attached to the printer body 10 so as to be freely opened and closed with respect to the printer body 10 and that, in use, is opened to a substantially horizontal position for holding a stack of paper thereon; and a paper pressing plate (member disposed inside the printer body) 3 that presses a paper sheet placed on the paper feed tray 2 against a transport mechanism such as a feed roller located above the paper pressing plate. As shown in FIG. 2, when the printer 1 is not in use, the paper feed tray 2 can be kept closed for saving space.

Figure 3:
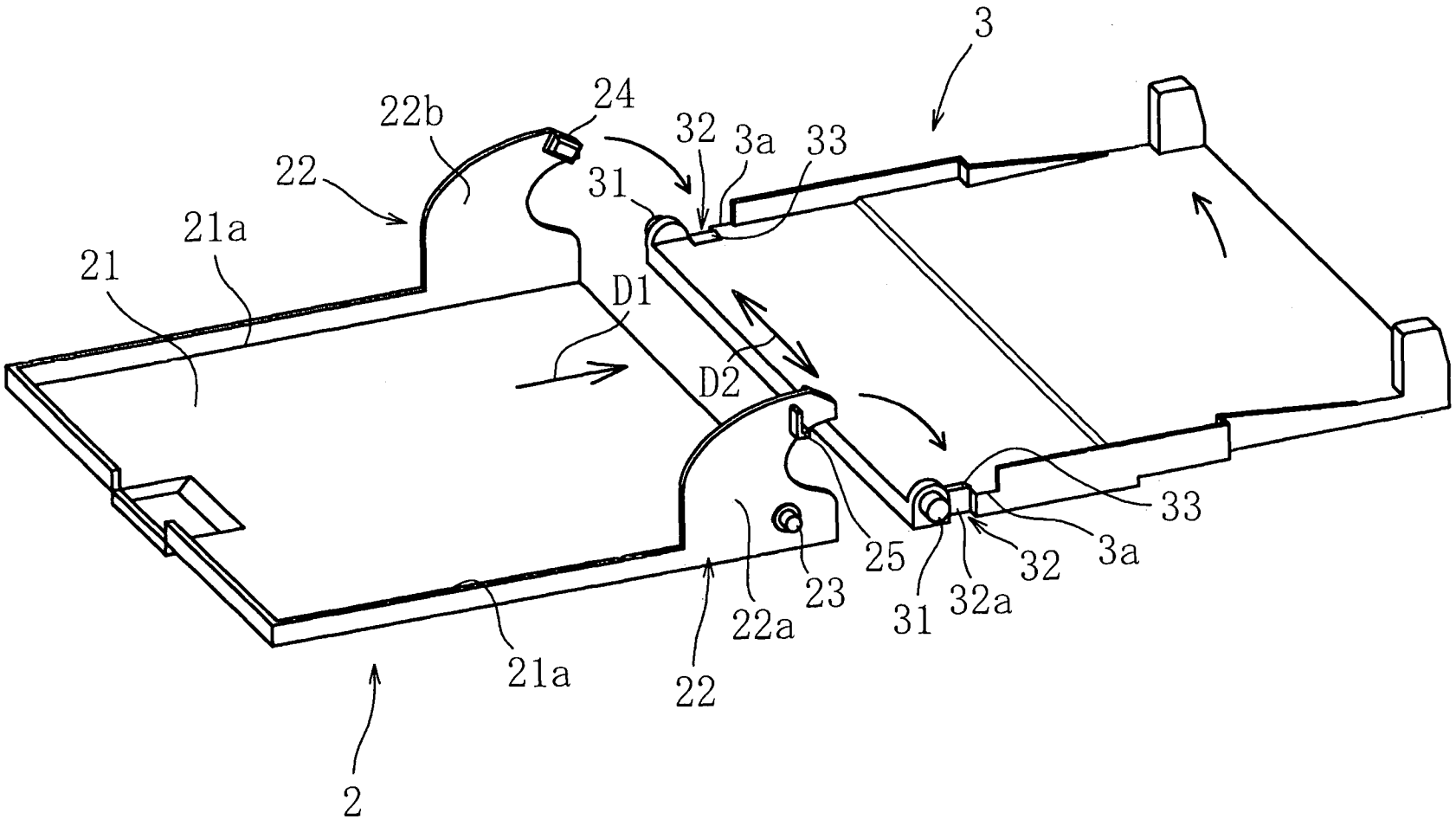
FIG. 3 is a perspective view of the paper feed tray and a paper pressing plate of the printer.
Figure 4:
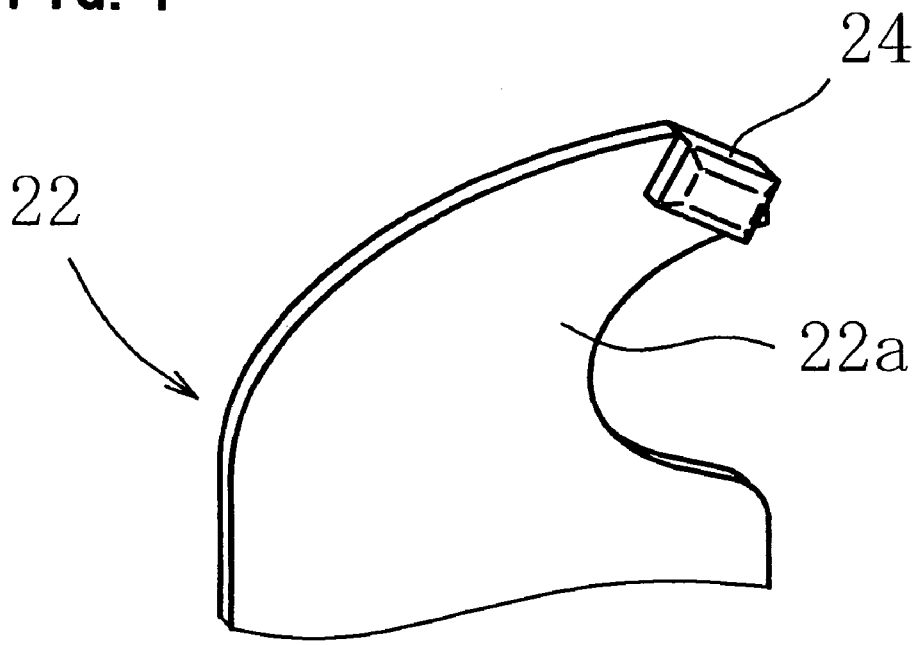
FIG. 4 is a perspective view of part of the paper feed tray where a protrusion is formed.

As shown in FIG. 3 and FIG. 4, the paper feed tray 2 has: a plate portion 21 on which a sheet of paper is placed; a pair of left and right side walls 22 extending upward from the both sides 21*a* of the plate portion 21 to be substantially perpendicular to the plate portion 21; and a pair of left and right supported portions 23 that are formed on the outer surfaces 22*a* of the side walls 22 to be rotatably supported on the printer body 10 by pivot shafts extending in a substantially horizontal direction D2 (hereinafter, referred to simply as "direction D2") substantially perpendicular to a paper feed direction D1 (hereinafter, referred to simply as "direction D1"). In this embodiment, the supported portions 23 serve as the pivot shafts and the printer body 10 is provided with bearings for the shafts. Alternatively, the printer body can be provided with the pivot shafts, with the paper feed tray having supported portions as the bearings.

The paper feed tray 2 further has a pair of left and right protrusions (contact portions) 24 protruding from the inner surfaces 22*b* of the side walls 22. Formed on the outer surfaces 22*a* of the side walls 22 are guide protrusions 25 to guide the opening/closing of the paper feed tray 2 along with guide grooves formed in the printer body 10.

Figure 5:
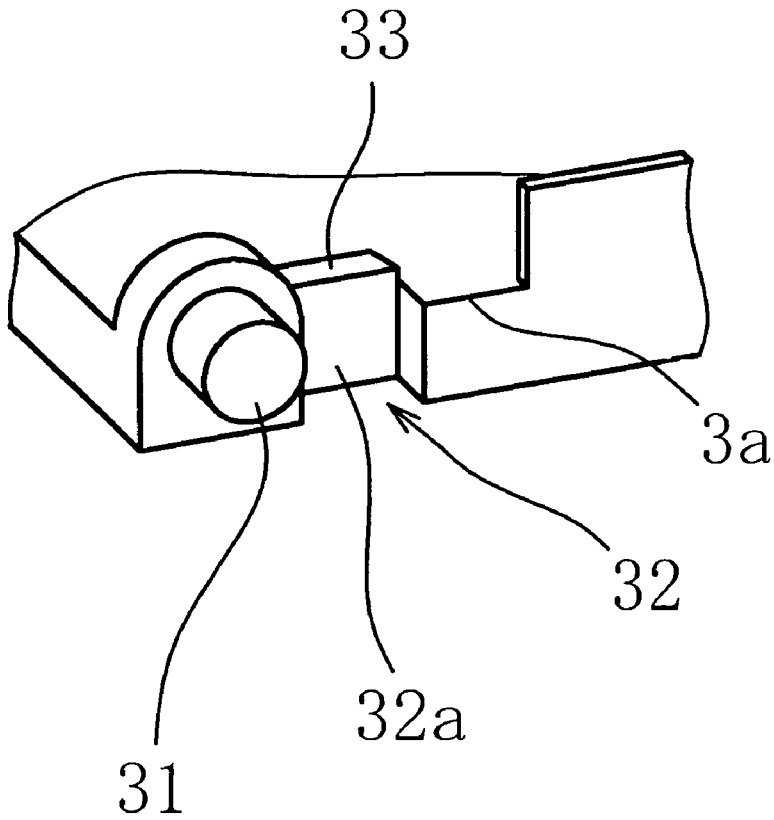
FIG. 5 is a perspective view of part of the paper pressing plate where a notch is formed.

As shown in FIG. 3 and FIG. 5, the paper pressing plate 3 has: a pair of left and right pivot shafts 31 extending in the direction D2; and a pair of left and right notches 32 formed by partially cutting the side portions 3*a* of the paper pressing plate 3. The paper pressing plate 3 rotates about the pivot shafts 31 to press the placed paper sheet against the transport mechanism thereabove. The notches 32 are formed so that, when the paper feed tray 2 is in the close position, the protrusions 24 are at least partially received in the notches and the side faces 32*a* of the paper pressing plate 3 face the protrusions 24 in a manner that are almost in contact with the protrusions 24. At the portion of the paper pressing plate 3 where each of the notches 32 is formed, there is formed a step 33, so that the portion 32*a* of the side face where the notch 32 is formed is somewhat wider than other portions. By forming the portion 32*a* of the side face where each of the notches 32 is formed to be wider than other portions, each of the protrusions 24 can more reliably contact the notch 32 portion.

Figure 6:
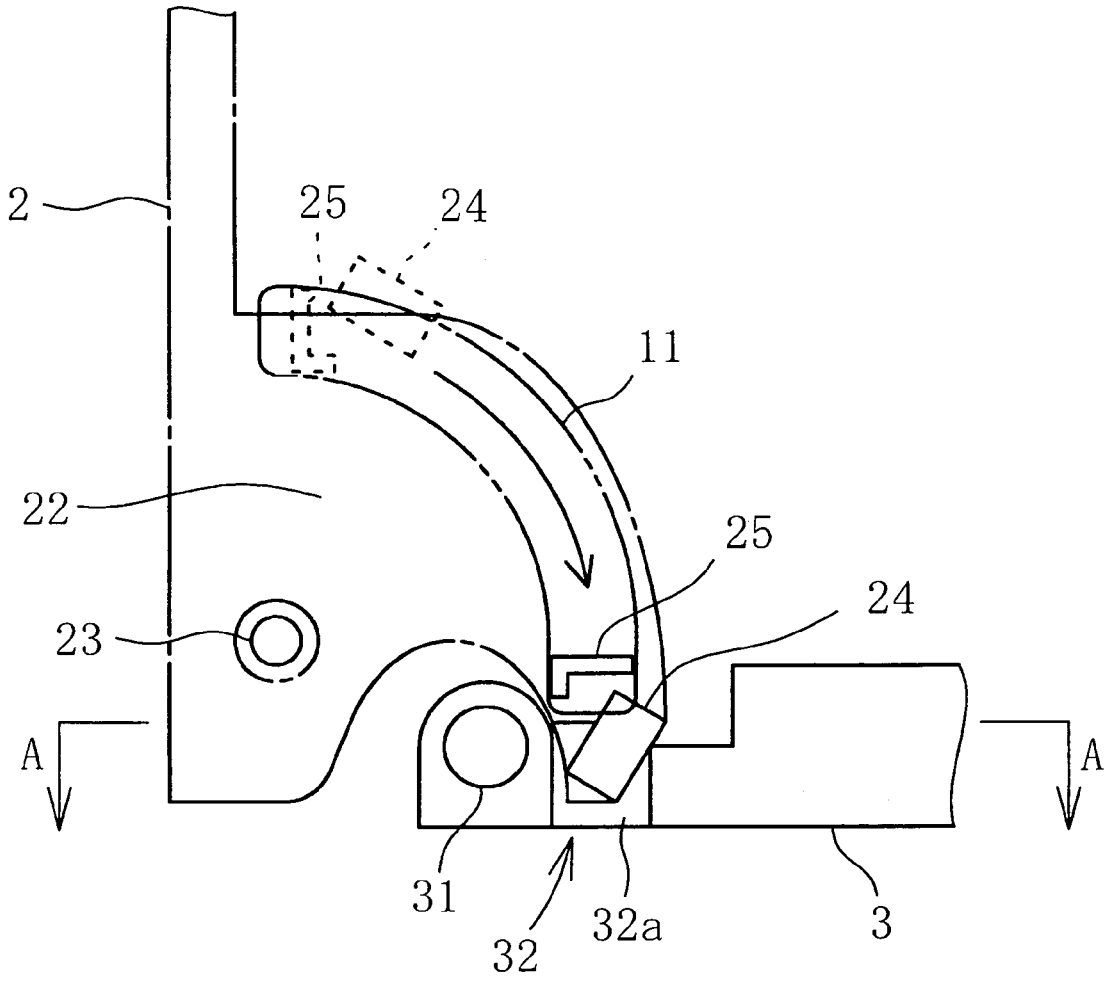
FIG. 6 is a side view showing the relative position between the protrusion of the paper feed tray and the notch of the paper pressing plate.

Referring now to FIG. 6, the relative position between the protrusion 24 of the paper feed tray 2 and the notch 32 of the paper pressing plate 3 is described in detail, with the paper feed tray 2 in the open or closed position. In FIG. 6, the protrusion 24 and the guide protrusion 25 in the position where the paper feed tray 2 is open are shown by the dashed lines, the protrusion 24 and the guide protrusion 25 in the position where the paper feed tray 2 is closed are shown by the solid lines, and the other portions of the paper feed tray 2 are shown by the chain lines. The guide groove 11 formed in the printer body 10 is shown by the chain double-dashed line.

As shown in FIG. 6, the paper feed tray 2 is rotated about the supported portions 23 while being guided by the guide protrusions 25 and the guide grooves 11, so that the protrusions 24 are partially received in the notches 32 when the paper feed tray 2 comes to the closed position.

Figure 7:
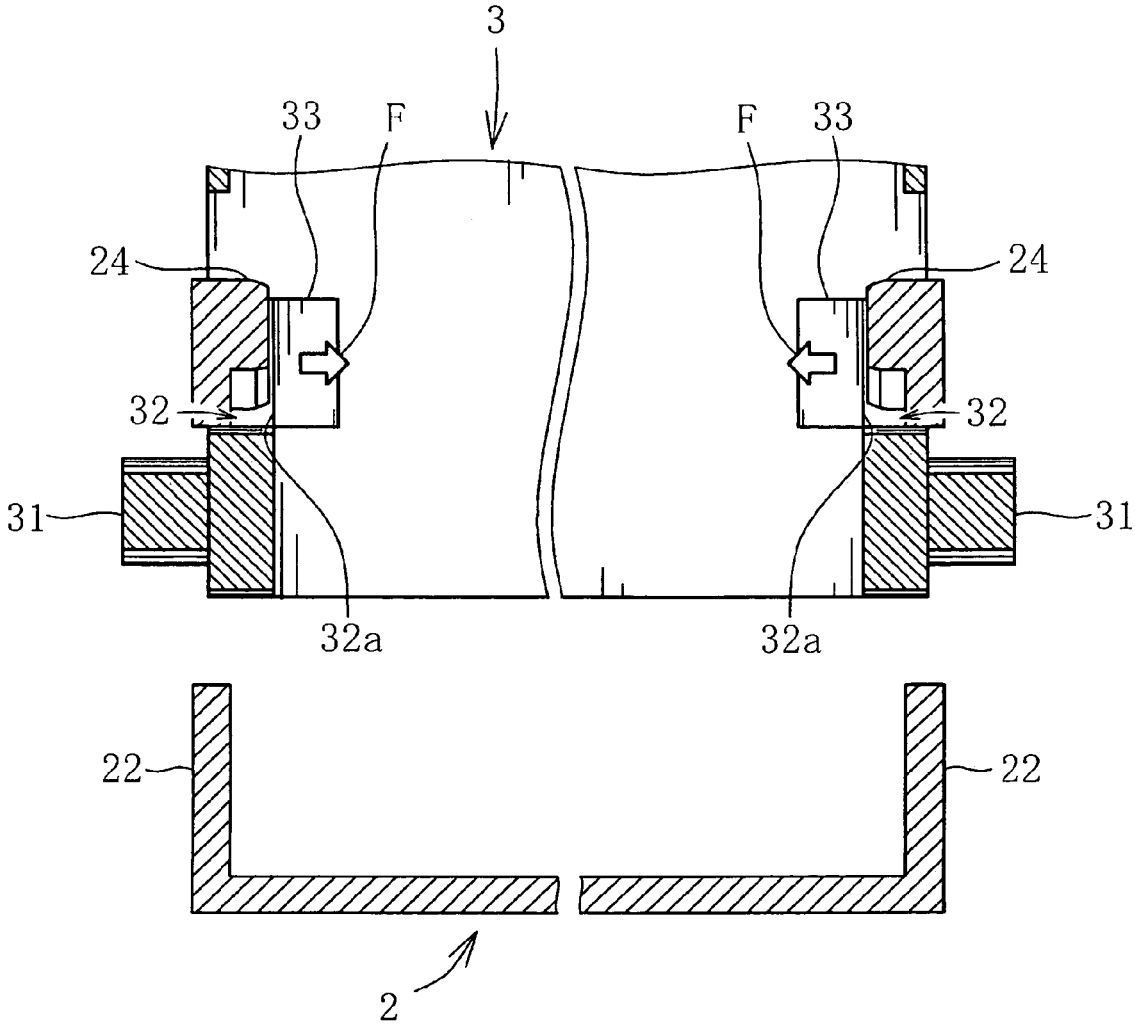
FIG. 7 is a cross sectional view taken along a line A-A in FIG. 6.
Figure 8:
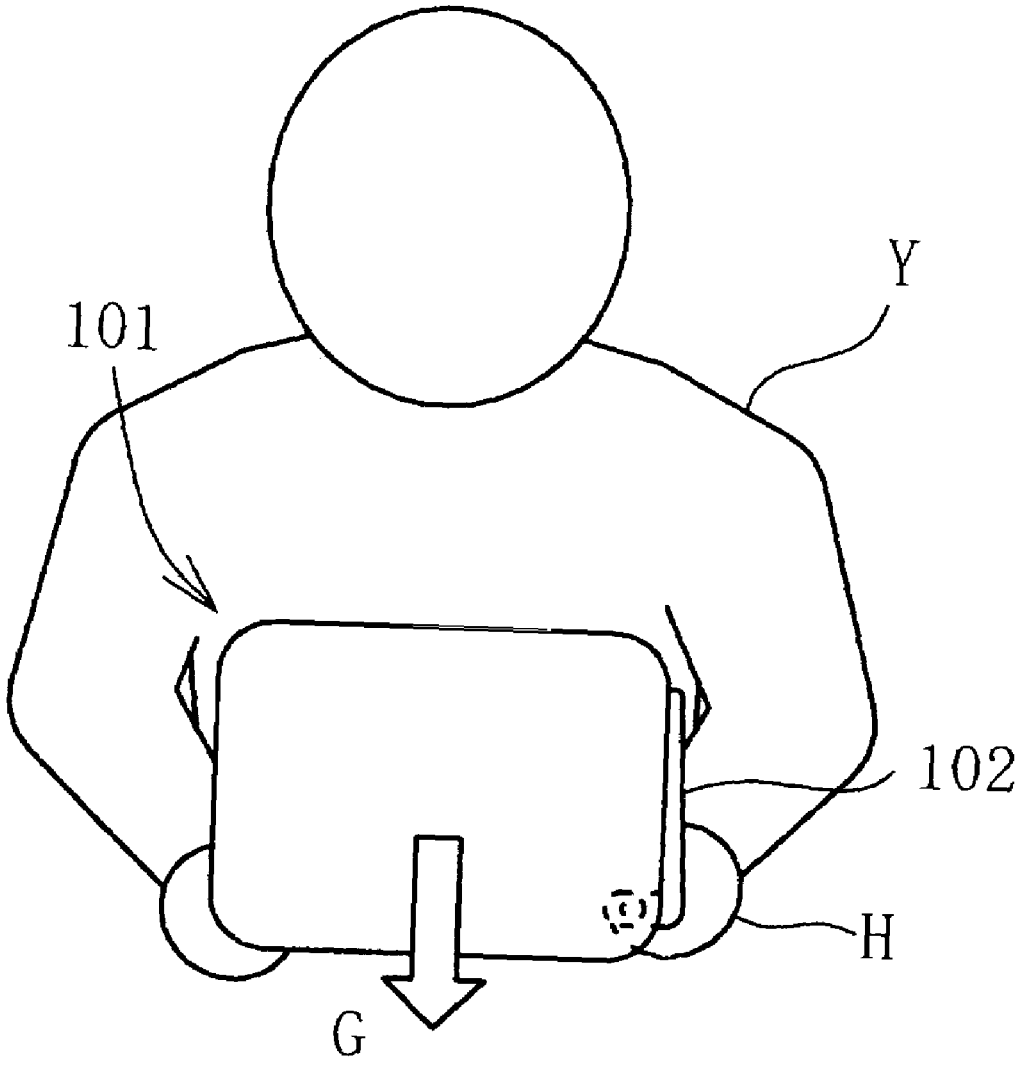
FIG. 8 PRIOR ART
FIG. 8 illustrates a user lifting a conventional printer while grasping its paper feed tray.
Figure 9B:
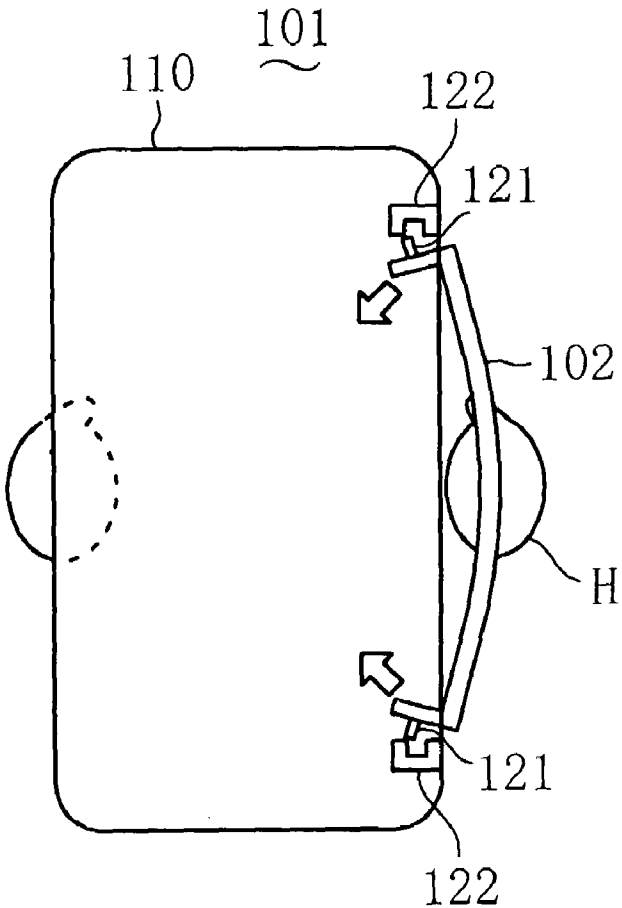
FIG. 9B PRIOR ART
FIG. 9A is a top view showing the paper feed tray of the conventional printer before the printer is lifted up, and FIG.
Figure 9A:
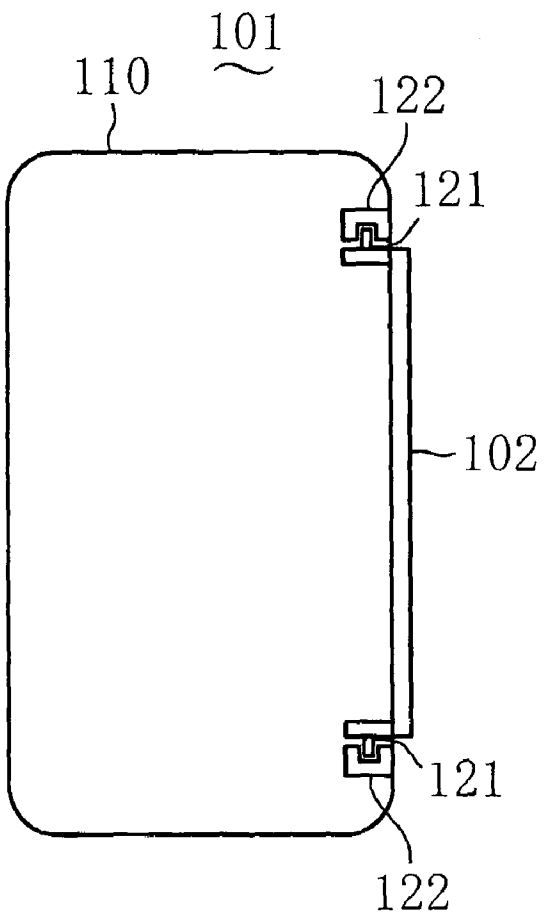
FIG. 9A PRIOR ART

Referring now to FIG. 7, the relative position between the protrusion 24 of the paper feed tray 2 and the notch 32 of the paper pressing plate 3 is described in detail, where a force acts on the paper feed tray 2 in the closed position to bend inward the side walls 22 of the paper feed tray 2. As described above, the protrusions 24 of the paper feed tray 2 are arranged so that, when the paper feed tray 2 is in the closed position, they are partially received in the notches 32 to face the side faces 32*a* of the paper pressing plate 3 in a manner that are almost in contact with the side faces 32*a*. When a force F acts on the paper feed tray 2 in this position to bend inward the side walls 22 of the paper feed tray 2, the protrusions 24 are pressed against the portions where the notches 32 are formed (more particularly, the protrusions 24 are pressed against the portions 32*a* of the side faces of the paper pressing plate 3 where the notches 32 are formed). As a result, inward bending of the side walls 22 can be stopped.

As described above, according to the printer 1 of this embodiment, when the force F acts on the paper feed tray 2 in the closed position to bend inward the side walls 22 of the paper feed tray 2, the protrusions 24 formed on the inner surfaces 22*b* of the side walls 22 are pressed against the side faces 32*a* of the paper pressing plate 3 where the notches 32 are formed so that the inward bending of the side walls 22 can be stopped. This can prevent the supported portions 23 formed on the outer surfaces 22*a* of the side walls 22 from being displaced by a large amount from their normal positions, thus preventing the paper feed tray 2 from becoming detached from the printer body 10.

The present invention has been described above using a presently preferred embodiment, but those skilled in the art will appreciate that various modifications are possible. Accordingly, all such modifications are intended to be included within the spirit and scope of the present invention. For example, the contact portions are not limited to the protrusions 24 formed on the inner surfaces 22*b* of the side walls 22, but can be other portions on the inner sides of the pair of left and right side walls 22 that are formed to, when the paper feed tray 2 is in the closed position, be almost in contact with portions on the side faces of an internal member disposed inside the printer body, which is positioned between the pair of side walls in the closed position, and that are pressed against the portions on the side faces of the internal member when the force F acts on the paper feed tray 2 to bend inward the side walls 22 of the paper feed tray 2.

The member inside the printer body 10 that the contact portions contact can be a member other than the paper pressing plate 3.

This application is based on Japanese patent application 2005-106668 filed Apr. 1, 2005, the contents of which are hereby incorporated by reference.

What is claimed is:

1. An image forming apparatus comprising:

a paper feed tray that is attached to an apparatus body of the image forming apparatus so as to be freely opened and closed with respect to the apparatus body and that is opened to a position for holding a sheet of paper thereon when the image forming apparatus is used, wherein the paper feed tray includes:

a plate portion on which the sheet of paper is placed;

a pair of left and right side walls extending upward from two sides of the plate portion to be substantially perpendicular to the plate portion;

a pair of left and right supported portions that are formed on outer surfaces of the side walls and are rotatably supported on the apparatus body by pivot shafts extending in a substantially horizontal direction substantially perpendicular to a paper feed direction; and a pair of left and right contact portions formed on inner surfaces of the side walls so that, when the paper feed tray is in the closed position, the contact portions are almost in contact with portions of side faces of an internal member that is disposed inside the apparatus body and positioned between the pair of side walls when the paper feed tray is in the closed position, wherein, when a force acts on the paper feed tray in the closed position to bend inward the side walls of the paper feed tray, the contact portions are pressed against the portions of the side faces of the internal member so as to stop the inward bending of the side walls.

2. The image forming apparatus according to claim 1, wherein the paper feed tray has a pair of left and right protrusions extending from the inner surfaces of the side walls, the protrusions serving as the contact portions, wherein the internal member has a pair of left and right notches formed by partially cutting side portions of the internal member so that, when the paper feed tray is in the closed position, the protrusions are at least partially received in the notches and the side faces of the internal member where the notches are formed face the protrusions in a manner that are almost in contact with the protrusions, wherein, when the force acts on the paper feed tray in the closed position to bend inward the side walls of the paper feed tray, the protrusions are pressed against the portions of the internal member where the notches are formed so as to stop the inward bending of the side walls.

3. The image forming apparatus according to claim 2, wherein the internal member is a paper pressing plate to press the sheet of paper placed on the paper feed tray against a transport mechanism located above the paper pressing plate.

4. The image forming apparatus according to claim 1, wherein the internal member is a paper pressing plate to press the sheet of paper placed on the paper feed tray against a transport mechanism located above the paper pressing plate.

* * * * *